US009597811B2

(12) United States Patent
Talavera

(10) Patent No.: US 9,597,811 B2
(45) Date of Patent: Mar. 21, 2017

(54) HAIR TRIMMING DEVICE

(71) Applicant: Victor Talavera, Alpine, CA (US)

(72) Inventor: Victor Talavera, Alpine, CA (US)

( * ) Notice: Subject to any disclaimer, the term of this patent is extended or adjusted under 35 U.S.C. 154(b) by 67 days.

(21) Appl. No.: 14/617,894

(22) Filed: Feb. 9, 2015

(65) Prior Publication Data

US 2015/0224655 A1 Aug. 13, 2015

Related U.S. Application Data

(60) Provisional application No. 61/937,298, filed on Feb. 7, 2014.

(51) Int. Cl.

| | |
|---|---|
| ***B26B 19/20*** | (2006.01) |
| ***B26B 19/06*** | (2006.01) |
| ***B26B 19/28*** | (2006.01) |
| ***B26B 19/22*** | (2006.01) |

(52) U.S. Cl.
CPC ..... *B26B 19/20* (2013.01); *B26B 19/06* (2013.01); *B26B 19/22* (2013.01); *B26B 19/28* (2013.01)

(58) Field of Classification Search
CPC ..... B26B 19/06; B26B 19/20; B26B 19/28
See application file for complete search history.

(56) References Cited

U.S. PATENT DOCUMENTS 2,674,037 A * 4/1954 Swenson ..... B26B 19/16 30/263
3,015,336 A * 1/1962 Caples ..... A45D 24/36 132/213
3,115,143 A * 12/1963 Queen ..... A45D 24/36 132/213
3,698,403 A * 10/1972 Morand ..... A45D 8/34 132/279
4,216,581 A * 8/1980 Van Slooten ..... B26B 19/44 30/133
4,314,405 A 2/1982 Park
4,628,601 A * 12/1986 Van Slooten ..... B26B 19/44 30/133
4,868,984 A * 9/1989 Elsherbini ..... B26B 19/44 30/133
4,958,432 A * 9/1990 Marshall ..... B26B 19/148 30/29.5
4,974,321 A * 12/1990 Yoshida ..... B26B 19/44 30/133

(Continued)

FOREIGN PATENT DOCUMENTS

EP 1381496 B1 12/2005
EP 2095916 A1 9/2009

(Continued)

*Primary Examiner* — Hwei C Payer
(74) *Attorney, Agent, or Firm* — Donn K. Harms

(57) ABSTRACT

A device for trimming the distal ends of hair drawn therethrough is provided which has a head portion having a handle portion extending therefrom. Drawing hair strands along a serpentine pathway formed between a positioning member and a recess in the head, causes distal ends thereof to momentarily project through an opening and into a cutting cavity where they are cut only when a flexible paddle urges the projecting distal ends into a cutting component. The length of the distal ends cut may be adjusted by engagement of variable sized interchangeable cutting components.

17 Claims, 5 Drawing Sheets

(56) References Cited

U.S. PATENT DOCUMENTS

| | | | | | |
|---|---|---|---|---|---|
| 5,022,154 | A * | 6/1991 | Johnson | B26B 19/18 | 30/34.05 |
| 5,461,780 | A * | 10/1995 | Morana | B26B 21/12 | 30/29.5 |
| 5,724,736 | A * | 3/1998 | Smith | B26B 19/44 | 30/133 |
| 5,884,402 | A * | 3/1999 | Talavera | B26B 19/00 | 30/124 |
| 6,588,108 | B2 * | 7/2003 | Talavera | B26B 19/16 | 30/124 |
| 7,007,388 | B2 * | 3/2006 | Wan | B26B 19/18 | 30/123 |
| 7,024,778 | B2 * | 4/2006 | Kuechler | B26B 19/20 | 30/124 |
| 7,040,021 | B2 * | 5/2006 | Talavera | B26B 19/16 | 30/124 |
| 2005/0138817 | A1 * | 6/2005 | Yamaguchi | B26B 19/20 | 30/233 |
| 2015/0224655 | A1 * | 8/2015 | Talavera | B26B 19/20 | 30/123.3 |

FOREIGN PATENT DOCUMENTS

| | | |
|---|---|---|
| WO | WO 00/07782 | 2/2000 |
| WO | WO 2015/120415 A1 * | 8/2015 |

* cited by examiner

HAIR TRIMMING DEVICE

This application is a Nonprovisional patent application claiming the benefit of Provisional Patent Application No. 61/937,298 filed on Feb. 7, 2014.

BACKGROUND OF THE INVENTION

1. Field of the Invention

The present invention relates to an improved device for the trimming of hair shafts. More particularly, it relates to a device which will trim an adjustable length from the distal ends of the individual hair shafts and allows for use by both hands. The device allows the trimming of distal portions of damaged hair from hair follicles, while leaving adjacent longer, healthy hair shafts intact. Optionally, it can be configured to impart conditioner or other hair products to the follicles being drawn therethrough or to heat and straighten the hair shafts.

2. Prior Art

Because of the changing styles and the inevitability that the hair on a person's head will grow and require cutting, visits to hairstylists and barbers are a common occurrence in the United States and throughout the world. Hairstylists and barbers are trained in the art of cutting hair at their client's direction using motorized and hand held implements such as scissors and electric clippers.

Occasionally, the person desires a new hairstyle, but more often they are happy with their current hairstyle and only require a fixed amount cut from the ends of the hair shafts. However, one vexing problem occurs whether the hair on a person's head is being cut by a trained stylist of the individual needing the trim or by an amateur. This occurs when only split ends and distal ends of damaged hair are desired for removal.

Split ends and damaged distal hair portions are a constant and continuous result of combing and brushing of hair, sun exposure, hair coloring, blow drying, and other actions of grooming the hair. Split and damaged hair ends have an appearance which can cause the hair to look unhealthy even where the rest of the hair follicle is in perfect condition.

One preferred current method of trimming split ends and damaged hair ends from the rest of the hair shaft, involves a time-consuming process. The hair must be stretched relatively taut using the hand or a comb or combination thereof. Once so-positioned, the stylist must take great care to clip only distal end portions of the individual hair follicles in a delicate trimming operation. An errant cut will yield harsh marks, uneven cuts, and the procedure is fraught with the possibility of accidentally cutting the center portions of healthy adjacent hair shafts yielding undesired results, especially where the person being groomed has very long hair.

Split ends and damaged hair ends are an especially vexing problem in the case of hair shoulder length and longer, in styles worn by women and men. Because of the varying length of the thousands of strands of hair involved from the scalp to the shoulders or below, it is especially time-consuming to try to trim only the distal ends of the hairs, a very small relatively equal amount, while not accidentally cutting mid sections of long adjacent strands. This process is made more difficult when the style of haircut is tapered through the length and just the short ends require cutting to maintain the tapered style.

Because of this tedious process, hours can be spent by professional hair stylists trying to trim the split ends on a person's long hair. Further, because of the delicate nature of the process, it is virtually impossible for a person with long hair to trim their own split ends and damaged hair ends. Such would involve cutting the split ends of hairs on the back of their head using a mirror and scissors which is obviously a task fraught with peril. One slip and their hairstyle could be ruined by cutting some long strands of the hair laying adjacent to the distal split ends or damaged hair ends on shorter hair shafts.

A number of devices have been developed over the years for trimming hair to be used by amateurs and professional hair stylists alike. Such devices attempt to allow amateurs to cut hair into professional looking styles or to enhance the ability of professional stylists by giving them another tool for their trade. While many of these devices address the issue of cutting hair and styling it, few devices address the ongoing problem of split ends and damaged hair ends on the distal ends of the hair shafts. Few provide an easy and dependable means for removing only a predetermined short length of the unhealthy distal ends.

In addition to the problem of split ends, on very long hair, for example extending below the shoulders, even if the ends are not split, all hair does not grow at the same rate and the aged distal hair shaft ends of older hair are often removed as a cosmetic aid to beautifying the head of hair getting rid of frizzy and unattractive hair ends.

To remove such damaged or unattractive hair shaft sections, without ruining the hair style of the individual or causing major change in styling, requires that only the short pieces of the distal ends of the hair shafts be removed. This must be accomplished without disturbing longer adjacent, healthy, normal appearing hair shafts. As with split end removal, this task can be very tedious, if not an impossible task, with the thousands of hairs on an individual's head.

For example, U.S. Pat. No. 5,519,939 (Smith) teaches a combination of a rotating brush, a comb and a razor blade arranged to cut a broad swath of hair when in use. However, Smith requires many adjustments by the individual using the device and it is intended to cut long sections of hair as determined by the circumference of the rotating brush.

The Smith device, because of its arrangement cannot be configured to cut only a short length of hair from the distal ends of the hair shafts in relatively equal amounts as required to trim split ends and unhealthy or unattractive hair ends. Further, because the brush must be drawn through the hair by hand to rotate the brush, the user is in constant risk of having hair encircle the brush into a tangle or of pulling the device sideways through the hair and accidentally cutting off broad swatches of adjacent hair. Often these razor blade cutters pull the hair to cut, rather than using a shearing action for removal of hair. This pulling may produce a great deal of discomfort for the individual receiving the haircut.

U.S. Pat. No. 3,115,143 (Queen) teaches of a guide for trimming hair whereby a user can taper or feather the cut of the hair from the neckline to the temples. This device, however, requires holding the guide in one hand and the electric clippers in the other. Such an arrangement precludes use by an individual in cutting his or her own hair and requires constant attention and the skill of a stylist or second person to cut the hair on which the device is being used. It would be virtually impossible for a user to cut the hair on the back of his or her own head in this manner. Queen, by its own teaching, addresses tapering and feathering of haircuts rather than just the removal of split ends. Further, it would be virtually impossible without great effort and time to cut only a substantially equal portion from the distal end of individual hair strands while leaving adjacent longer hair strands untouched with this device.

U.S. Pat. No. 5,213,116 (Stein) teaches of a hair trimming device using a rotatable blade on a comb like guide. This device is, however, designed to cut bangs rather than split ends, and because as taught it requires two hands to use it, it is unlikely that anyone could use this device on the back of the head without the aide of another individual to guide the device. Again, trimming substantially equal amounts from the distal ends of hairs would be extremely time-consuming and require great dexterity if it could be accomplished.

U.S. Pat. No. 7,040,021 (Talavera) is a leap forward in the art and teaches a unique device that accomplishes the difficult task of cutting only the distal ends of the hair strands and can be used by a trained hair stylist or an amateur. The device of Talavera may also be used by a single individual to trim the ends of their own hair. While a leap forward in the art, the Talavera device lacks an easy cut length adjustment and employs a metal rotating blade for cutting which can dull and which may cause concern that hair strands might wind upon it and be cut, or the blade might move off its axle and accidentally cut central portions of hair strands.

As such, there is a continuing and unmet need for improvement in devices used in the field of hair styling. In particular where cutting split ends and trimming a predetermined section length from the distal ends of the hair shafts is required. Such a device should endeavor to improve on safety of the device where it is powered during use by eliminating rotating metal or other rotating components used for cutting hair strands. Such a device should have structure to allow for adjustment of the length of hair strands removed from hair distal ends. For ease of use, such a device should be employable being held by either hand of a user and in two directions of pull. Such a device should also be easy to use by trained stylists and users alike to easily strip hair ends while minimizing the danger of cuts to adjacent healthy hair shafts.

SUMMARY OF THE INVENTION

The device and method herein disclosed and described achieves the above-mentioned goals through the provision of a user-configurable, component-interchangeable, hair maintenance tool allowing a user a safe and quick device to safely remove substantially equal portions from the distal ends of hair shafts which may have split or otherwise been rendered unattractive or unhealthy in appearance. The device is providable as a kit with various components which may be added or substituted onto removable engagement with the main device to adjust the length of the trimmed portion of hair from hair strands. In another configuration it may be employed to also dry the hair, or allow for the use of heated engageable components, to straighten or curl certain portions of the hair if desired.

The split end or damaged hair end cutting operation is accomplished in a novel manner using oscillating cutting assemblies on both sides of a cutting cavity thereby eliminating the rotating blades which can dull and wind follicles. The arrangement of cutting assemblies on both sides of a cutting cavity into which hair follicles must be pushed, allows for the safe removal of only portions of the distal ends of the hair. Further, the process enabled by this configuration leaves adjacent mid portions of shafts of longer hair lengths uncut, until those strands are communicated through a serpentine pathway to communicate the distal ends of those strands into the cutting chamber for urging into cutting assemblies by a flexible rotating member.

Several components incorporated into the operation of the disclosed trimming device serve to enhance or improve that operation. Such include the implementation of a rotating hair paddle, with flexible ends which is positioned to contact and urge the distal ends of hair follicles into a set of cutting blades of an opposing clipping and trimming assembly.

Powering operation of this novel opposing parallel clipping assembly, and cutting blades, is a gearing and cam assembly which communicates the force from the motor shaft rotation, to linear translation, thereby enabling the operation of both the rotation of the hair paddle and translation of the clipping mechanism into which hair is urged by the paddle, using a single motor.

In the device, an electric motor may be rotationally controlled by a directional on-off switch to change rotation during different orientations of use, while hair is being pulled through the device's serpentine path. A serpentine path for hair travel is formed by a user operable positioning mechanism which may have brush-like or ridged protrusions for constraining translating hair through individual pathways, and opposing surfaces of a cavity or recess formed into a face. Access to the pathway for hair is provided by the operation of a lever which opens and locates the positioning mechanism to and from the recess.

In use, engaged with the hair sliding along the formed serpentine pathway, the motor rotates in the user-controlled rotational direction, and communicates rotation to a combination of gears that rotate the hair paddle component in the direction of the motor, while also applying a rotational force to an angled gear running perpendicular to the motor shaft axis. This perpendicular gear is fixed to the center of a disc or similar component with an off-center attachment point where a linkage connects the disc with the moving component of the clipping mechanism. As the gear rotates the disc, it also forces the attachment point of the linkage to follow an orbital path around the disc's center rotational axis.

This orbital movement of the linkage noted above creates the foundation for a cam-linkage assembly that converts the powered rotation into linear translation. This conversion occurs as a result of one attached distal end of the linkage rotating in an orbital fashion around the rotating disc's center axis, while the other distal end of the linkage is constrained to a linear path as it is attached to a linearly constrained clipping mechanism component. Therefor, this combination of an orbital movement at one distal end of the linkage and a linear constrainment at the opposite end creates an oscillating linear translation of the constrained distal end.

The clipping mechanism assembly includes a baseplate, parallel fixed-bladed elements, a moving bladed element which is attached to the linkage member and complimentary to the fixed-bladed elements, and a plurality of compressing components such as torsion springs which impart a compression bias which mates the complimentary surfaces of the fixed and moving bladed elements to the baseplate.

The torsion springs, or other biasing component, are installed onto shafts or axles that concentrically pass through the springs' center while the springs' distal ends provide the compression necessary to keep the bladed elements in contact with one another. The shafts also allow the springs to translate or distort along the shafts' surfaces in harmony with the moving, bladed element as it performs its clipping duties.

The relative translation between the two bladed elements is a result of the linear translation of the constrained linkage end mentioned above as it is attached to the moving bladed element. This relative translation between bladed elements creates a shearing and cutting action in a novel, parallel and center facing arrangement within a cutting cavity.

Prevention from accidental cutting of hair shafts, is particularly preferred and afforded by the fact that the hair shafts must first communicate into the clipping mechanism. This can only occur when the distal end of a hair shaft being pulled through the serpentine path created by positioning of the positioning mechanism into the center of the serpentine path, releases from engagement with the positioning mechanism. At this apex point of the positioning mechanism, the hair shaft loses sandwiched positioning between the positioning mechanism and an adjacent wall, and is thrust upwards into the cutting cavity due to momentum and the potential energy stored in the bending of hair shafts, and their proclivity to straighten in small segments.

Positioned within this cutting cavity the hair shaft will remain uncut until it comes into contact with the flexible ends of a rotating hair paddle. The hair paddle preferably includes surfaces formed of or coated in a flexible material such as rubber or polymeric material, that enables the paddle on contact with the distal end of the hair shaft and push or force it into the blades of the oscillating clipping mechanism as the paddle rotates toward them in one direction or the other. This biased contact or pushing of the hair shaft distal ends into the blade assemblies on both opposing sides of the cutting cavity, causes a severing of the hair shafts at the appropriate and precise length.

Interchangeable length adjustable walls may be configured to determine an amount of the hair shaft which will enter the cutting cavity and thus be severed by the action of a flexible paddle urging the entering hair end through a severing component while the device is in use, may be employed. The varying sized opposing walls are formed into an interchangeable component which may be easily removed, traded, and reinserted.

As the wall thickness of the interchangeable component increases, the internal passage of the serpentine pathway or internal cavity decreases in size. Furthermore, as this internal cavity gets smaller, the distal end of the hair approaching the apex of the pathway is held in the serpentine pathway longer, and the length of the distal end of the hair shaft entering the cutting cavity though the opening communicating thereto opposite the apex, is proportionally reduced. Thus, less hair is trimmed from each hair shaft.

In addition to interchangeable length determining elements, other components may also be formed into the device, or attached, traded, and removed from the device in order to accomplish other hair maintenance related tasks. Such components may act as hair straighteners, dryers or curlers that further reduce the need to visit a professional hair stylist and save the user time.

Additionally, an elongated member providing a hair positioning mechanism to form a serpentine pathway for hair strands may be configured with a conditioning cavity adapted for engagement of a pad or fluid impregnated component for communicating hair conditioner and other products to the hair follicles being drawn thereover during communication through the serpentine pathway. Apertures in the surface of the elongated member positioning component will communicate liquid or vapor from the reservoir of fluid held in the conditioning cavity.

It is an object of this invention to provide a hair trimmer adapted for precision cutting of a length of hair, only from the distal end of hair strands, while leaving adjacent mid sections of adjacent hair strands uncut, in a safer and more efficient method than previously available.

It is a further objective of this device to provide such a clipper which uses a pliable rotating paddle or paddle end, which frictionally contacts hair strands' distal ends entering a cutting cavity, to push them into an adjacent and translational clipping mechanism, thereby insuring that only distal ends are cut and no hair can entangle any rotating cutting mechanism.

Still, another object of this invention is to design a unique clipping assembly that can cut equally well in either direction or orientation of use through employment of parallel, center-facing electric shears.

An additional object of this invention is to enable a user to adjust the desired length of the hair shaft to be severed while in use with easily interchangeable elements.

These together with other objects and advantages which become subsequently apparent reside in the details of the construction and operation as more fully hereinafter described and claimed, reference being had to the accompanying drawings forming a part thereof, wherein like numerals refer to like parts throughout.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

BRIEF DESCRIPTION OF DRAWING FIGURES

DETAILED DESCRIPTION OF THE PREFERRED EMBODIMENTS OF THE INVENTION

Figure 1:
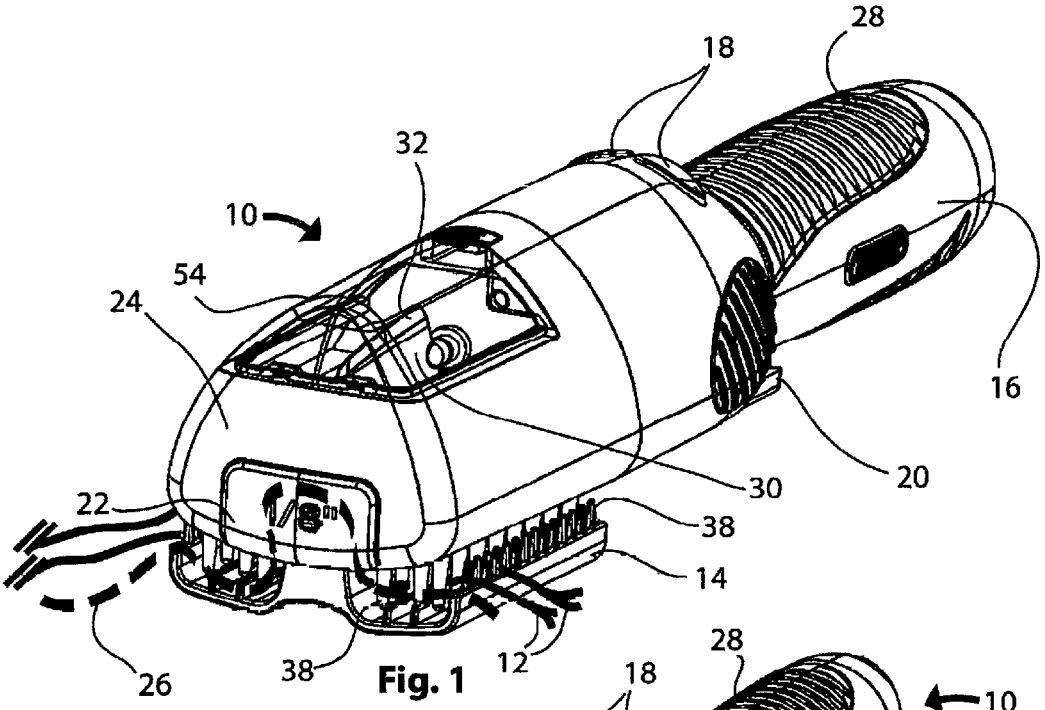
FIG. 1 depicts a perspective view of the device with a positioning mechanism positioned within a recess in the face of the head of the device, in an as-used position.

Referring now to the drawings of FIGS. 1-9 are the modes of the device 10 employed for the trimming and styling of hair shafts 12. In FIG. 1, a perspective view of the hair trimmer device 10 is shown with an elongated member forming a hair positioning member 14 operatively positioned to an as-used position within a recess 15 (FIG. 3) formed into the face 17 of the cutting head 24 having a handle 16. In this figure the handle 16 for single-handed operation, a directional on-off switch 18 which causes the paddle 30 of the device to rotate in either direction, an elongated hair positioning member 14, a lever 20 which pivots to operate the positioning member 14, into and out of the recess 15, as well as an interchangeable cutting length component 22 are depicted.

The elongated handle 16 extends from the cutting head 24. This handle 16 may include a gripping surface 28 formed of rubber, polymeric, or similar material that provides a easy to grip surface and prevents the handle 16 of the device 10 from slipping from a users grip while hair shafts pass through the serpentine path 26 formed between the positioning member and the wall surface of the recess 15 in the cutting head 24.

Located on one of the handle 16 or the cutting head 24 is a power switch which is preferably a directional on-off switch 18 that determines the direction of operation of the internal cutting components or assemblies, including the rotating hair paddle 30 depending on the direction of use by the user which is determined by in which hand the device 10 is held. When using the device 10 on one side of the head 24 or the other, the direction may be reversed by changing the switch between a single off position, and two on positions which the user may choose.

The hair paddle 30 depicted, works in combination with the cutting component positioned on opposing sides of the cutting cavity 13 which cut only the distal ends 34 of hair shafts 12 from the hair strand 12 or shaft. The paddle 30 contacts hair distal ends 34 communicating into the cavity, and urges them with a frictional engagement by pushing them toward and through one of the opposing cutting components on opposing sides of the cutting cavity 13 of the device 10. The direction of paddle 30 rotation will change depending upon which of the two on-positions to which the switch 18 is actuated and the hair distal ends are pushed toward the respective one of the two cutting components which is located in the direction of the rotation of the paddle 30.

All, or a leaded edge portion 32 of the paddle 30 is preferably formed with pliable material which is flexible such as rubber, polymeric materials, or other soft flexible material adapted to the task. In this fashion, when the flexible leading edge portions 32 forming the distal edges of both sides of the paddle 30, push the distal ends of the hair strands to a cutting contact with one of the cutting components, only the distal ends 34 of hair shafts 12 entering the cutting cavity 13 through the opening 21, and pushed toward and into contact with the oscillating blades of the cutting component are cut. Thus the entire remaining portions of hair shafts sliding along the serpentine pathway, are not contacted by the paddle 30 nor cut by the device 10. Because the paddle 30 is either formed of soft material such as rubber or plastic, or other polymeric material, or has leading edge portions 32 formed thereof, the paddle 30 will not cut the hair strands during contact with them.

The length of the severed distal end 34 of the hair shaft 12 may be determined by the wall thickness 36 of the interchangeable cutting length component 22. This interchangeable cutting length component 22 changes the distance of the wall surfaces of the recess 15 or internal cavity of the serpentine path 26, from the surface of the elongated positioning member 14 which is positioned therein when the device 10 being employed. Changing this distance proportionally affects the amount of the distal end of the hair shaft permitted to enter the cutting cavity 13.

Figure 2:
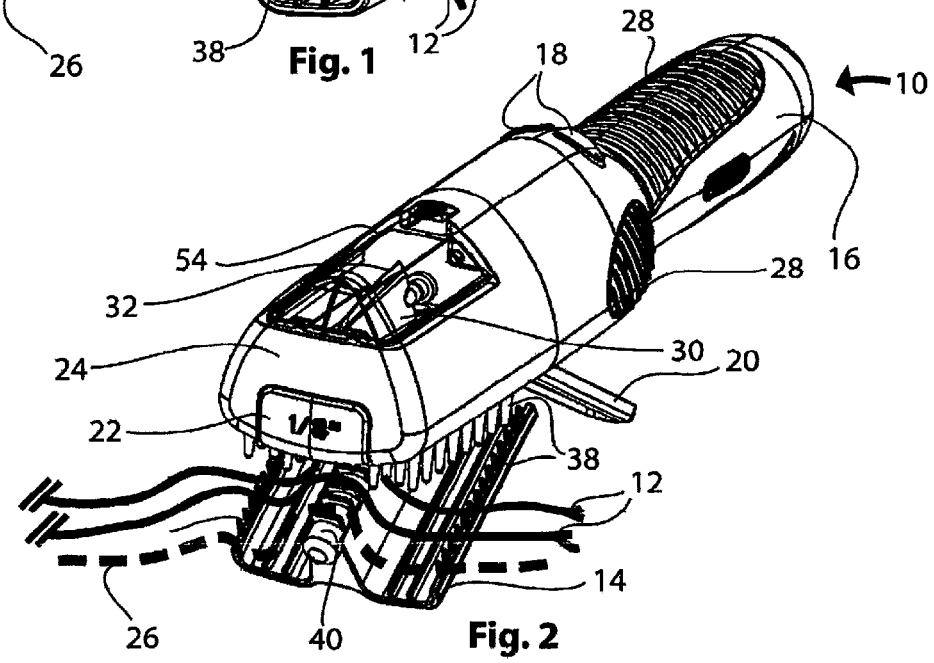
FIG. 2 depicts a perspective view of the device with the positioning mechanism in an open position forming a gap between the recess and the facing surface of the positioning mechanism to allow insertion of hair strands therebetween.

FIG. 2 illustrates the same view as FIG. 1, with the elongated member forming the hair positioning member 14 which is depicted spaced from the recess 15 and ready for the insertion of hair shafts to be sandwiched between the surface of the elongated member forming the positioning member 14 and the walls of the recess 15 depending into the face 17 of the head 24. This positioning member 14 is moved to an open position, spaced from the recess 15 by release of a lever 20 during use whereupon a biasing component such as a spring, acts upon one or both of the operationally attached lever 20 and the positioning member 14 which may be in a pivoting engagement with each other and, and thereby urges both in a direction away from the body of the device 10. Of course this system could be reversed.

As this lever 20 is grasped by a user and forced closer to the handle 16 of the body of the device 10, the gripping force overcomes the force of a biasing component, and urges the elongated member forming the positioning member 14 into an engaged position axially positioned within the elongated recess 15.

Also shown in FIGS. 1 and 2 are hair opposing protrusions 38, formed on the surface of the positioning member 14, that may be employed to constrain the hair shafts into the serpentine path 26 in a plurality of individual separate serpentine pathways, divided by the opposing protrusions 38 extending from the positioning member 14 and/or the face 17. By positioning the hair shafts 12 into individual separated serpentine pathways along the serpentine path 26, the device may prevent tangling of hair shafts 12. Integrated with these protrusions 38, or axially along the positioning member 14, may be heating or drying elements (not shown but well known), to allow the device 10 to accomplish other tasks relating to hair shaft 12 maintenance and styling such as heating hair between two mating surfaces to straighten it.

Figure 4:
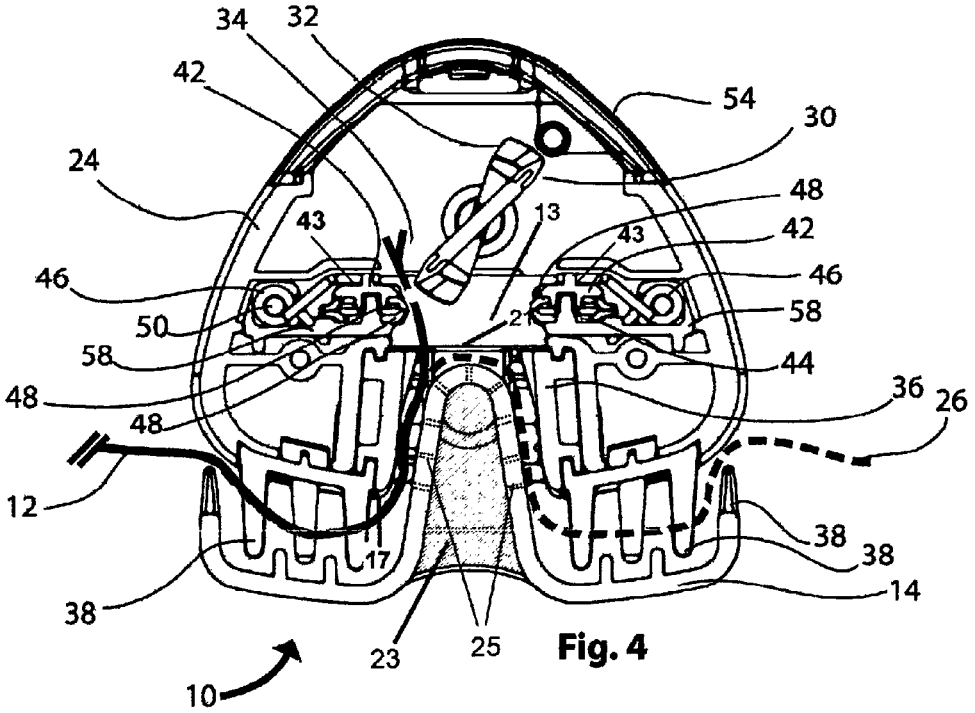
FIG. 4 depicts an end cross-sectional view of the cutting area of the device after the hair shaft has entered the cutting cavity and has been urged into a cutting component by a pliable paddle edge, and severed by the cutting component and also shows an optional hair conditioner reservoir.

Also optional but employed in one preferred mode of the device 10 herein as shown in FIG. 4 for example, a reservoir 23 may be formed into a channel or cavity of the elongated member forming the positioning member 14. The reservoir 23 may have an impregnated pad, or other fluid-holding component for a supply of hair conditioner or other products which may be communicated to the hair strands while they traverse through the serpentine path shown. Apertures 25 shown in dotted line, communicate between the reservoir 23 and the surface of the positioning member 14 which faces and depends into the recess 15 formed in the face 17 of the head of the device 10 in an as-used positioning with the elongated member forming the positioning member 14 positioned within the recess 15 with a facing surface of the positioning member 14 proximate to the face 17 surface of the recess 15.

Figure 3:
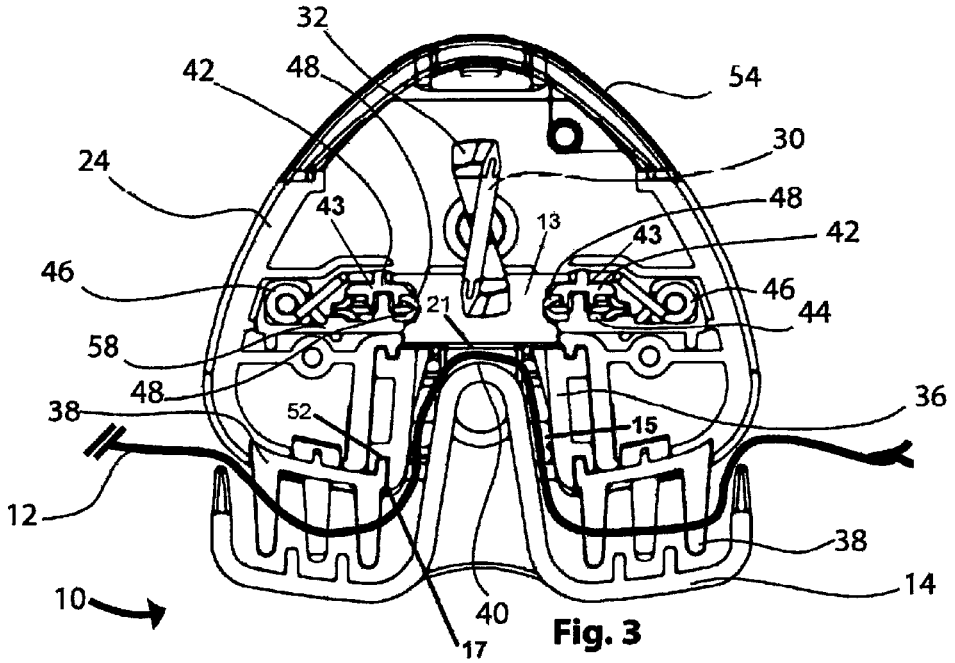
FIG. 3 depicts an end cross-sectional view of the cutting area of the device, with the positioning mechanism in the as-used position of FIG. 1, prior to the distal end of a hair shaft end entering a cutting cavity through an opening.

In FIGS. 3 and 4 the device is shown in a cross-sectional view illustrating the interior components of the cutting head 24. Here a hair shaft 12 communicates along the serpentine path 26 of the device 10 which is formed when the positioning member 14 is operatively positioned to the as-used position within the recess 15 formed in the face 17. In FIG. 3, the hair shaft distal end 34 has not yet reached the internal serpentine pathway apex 40 located on the positioning member 14 across from the opening 21 communicating to the cutting cavity 13.

In sliding along the serpentine path 26 formed between the face 17 and the recess and the positioning member 14, the hair shaft 12 remains sandwiched between the surface of the positioning member 14 and the face 17 surface of the recess 15 which may be formed and adjusted using the interchangeable cutting length component 22. This sandwiched engagement of the hair shaft 12 thereby prevents any portion of the hair shaft 12, from entering the cutting cavity 13 through the opening 21, until a distal end 34 reaches the apex 40 and a portion thereof extends through the opening 21 and into the cutting cavity 13.

The device 10, using the pliable leading edge 32 of the paddle 30 to urge the hair shaft 12 distal ends will function with any oscillating or other cutting component on one, but preferably on both opposing sides of the cutting cavity 13, where the paddle 30 will be able to push the distal ends 34 and into the cutting component and cause a cutting only of the distal end 34 from the hair shaft 12. Thus, those skilled in the art will realize the disclosed cutting component shown as oscillating assemblies, may be substituted for another.

Within the cutting cavity 13 as shown, in a preferred mode there are opposing cutting components 43 on both sides of the cutting cavity. The cutting components 43 as depicted, have an upper, linearly translating bladed element 42, a lower fixed bladed element 44, a plurality of torsion springs 46, and shearing blades 48. These cutting components 43 are assembled in such a fashion that the translating bladed element 42 remains in contact with a its complimentary fixed bladed elements 44. Of course other cutting components may be employed if positioned on opposing sides of the cutting cavity, where such a cutting component will only cut distal ends 34 which the paddle may urge therein.

In operation, the translating bladed element 42 oscillates while linearly constrained with the fixed bladed elements 44 and thereby forces the shearing blades 48 to oscillate relative to each other. This oscillating action of the shearing blades 48 provides one preferred cutting component 43 to sever only a distal end 34 of any hair shaft 12, that is urged into contact with the cutting component 43 located on opposing sides of the cutting cavity 13 which must be urged by the pliable leading edge 32 of the rotating hair-paddle 30. The translating bladed element 42 remains in contact with the fixed bladed element 44 due to the compressive biasing of the torsion springs 46. These springs 46 slide or distort along a shaft 50 in unison with the translating bladed element 42. The flexible paddle 30 or paddle 30 with at least a flexible distal edge, may contact and bend and slide upon the surface of the cutting component 43 during rotation.

Also, shown in FIGS. 3 and 4 is the method of attachment of an interchangeable cutting length component 22 which may be employed to vary the length of a distal end cut from a hair shaft 12. The interchangeable cutting length component 22 is inserted into the device 10 and mates using an attachment component such as depicted complimentary channels 52. These complimentary configured channels 52 mate within a mating portion of the recess 15 forming a cavity surrounding an opposing surface of the elongated positioning member 14 having the apex 40 opposite the opening 21 when operatively positioned. The wall thickness 36 of the interchangeable cutting length component 22, varies the distance of the surface of the recess 15 from the surface of the positioning member 14 when therein, and determines the amount of the distal end of the hair shaft 12 removed during cutting and is further illustrated in FIG. 9.

Figure 5:
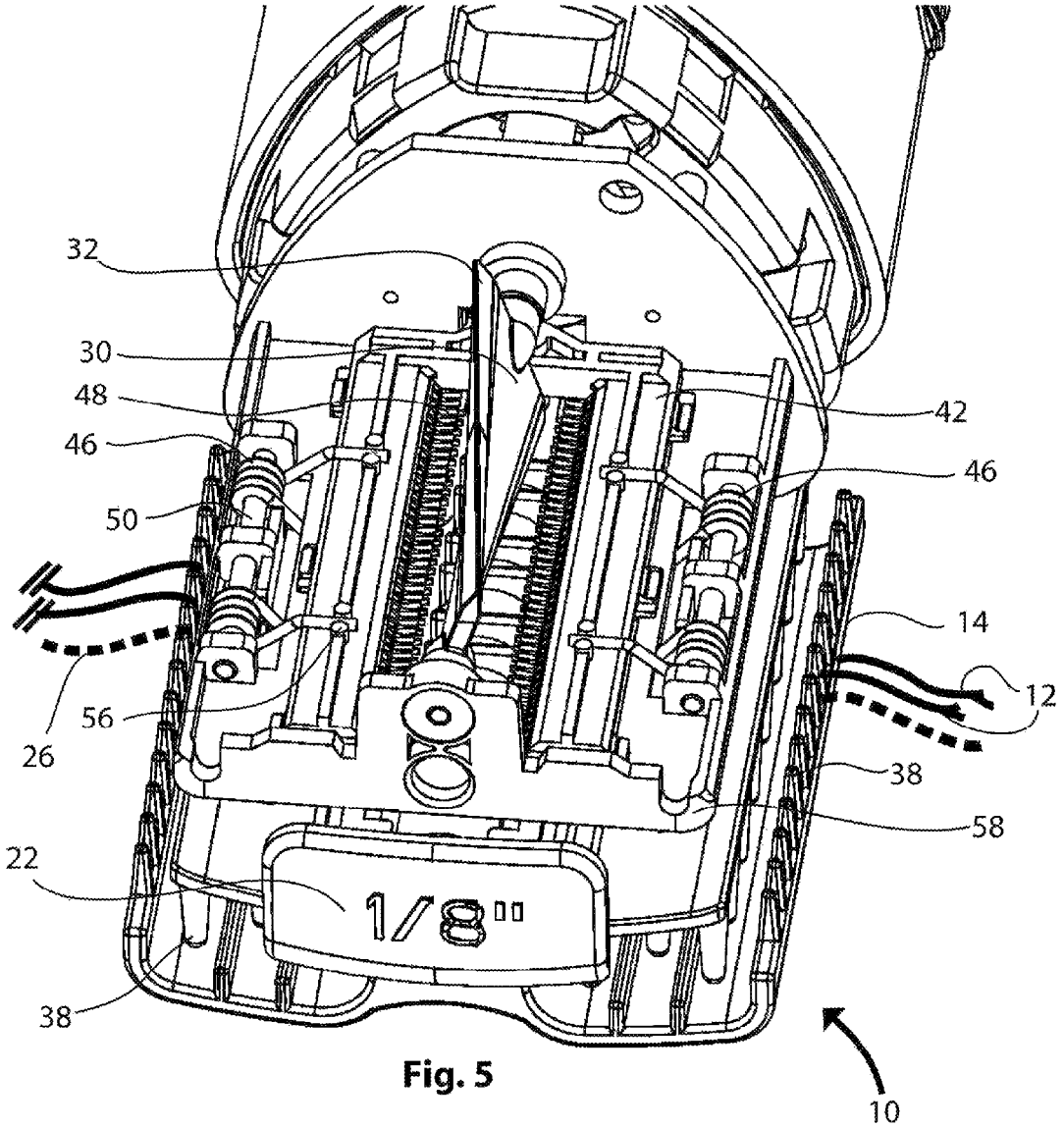
FIG. 5 depicts a perspective view from above the device's cutting area with the external housing removed showing the opening into the cutting area in between opposing blades and the pliable paddle having a diameter wider than the opening.

In FIG. 5 a perspective view of the cutting cavity 13 is shown with the transparent window 54 and external housing of the cutting head 24 removed for ease of viewing. This perspective more clearly shows the components described previously while referring to FIGS. 3 and 4. In addition to the aforementioned components that serve the same previously stated purposes, a torsion spring containment feature 56 is shown formed into the translating bladed element 42. This feature 56 constrains the torsion spring distal end to the translating bladed element surface, solidifying the springs' compressive biasing that keeps the translating bladed element 42 in contact with, and linearly constrained to the fixed bladed elements 44 opposite the surface shown is the other distal end of the torsion springs 46. This end is in contact with the opposite surface of the baseplate 58 shown, and provides the second point of contact required for the spring to maintain a compressive biasing between the translating bladed element 42 and the fixed bladed elements 44.

Figure 6:
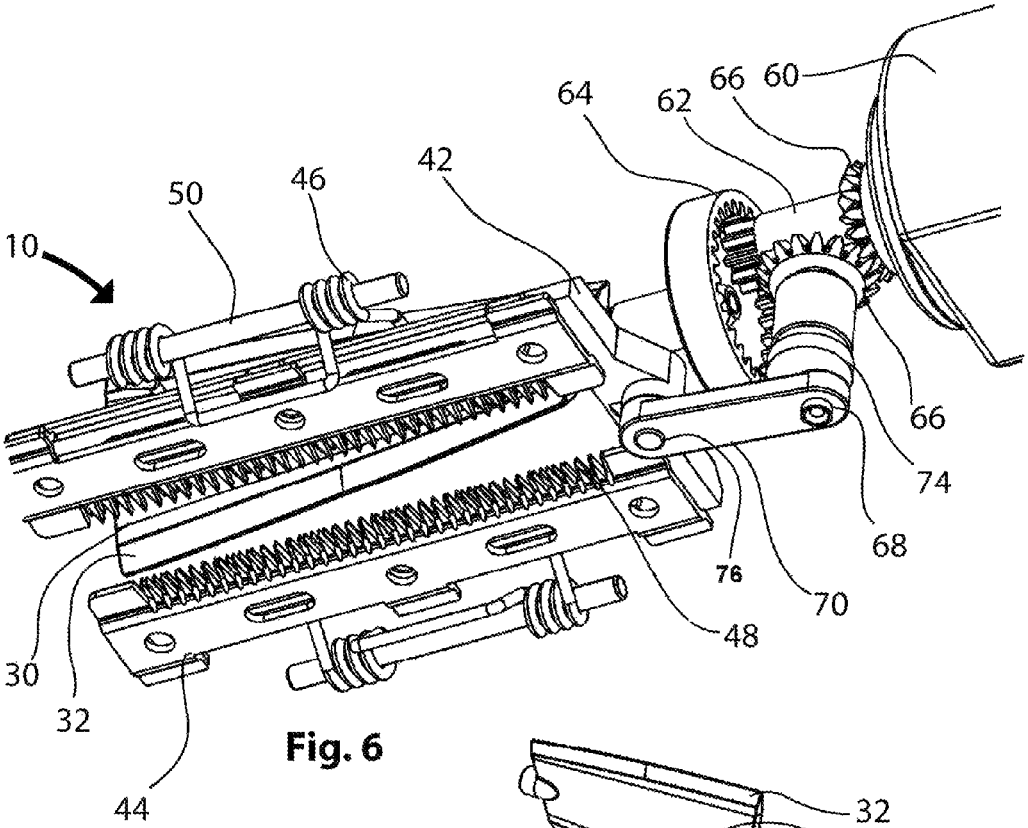
FIG. 6 depicts a perspective view from below the cutting area with the external housing, positioning mechanism and baseplate removed to provide a better view and showing the paddle in position to urge hair strand distal ends into the cutting component.

FIG. 6 illustrates the means by which the disclosed oscillating cutting component 43 operates within the device 10. Although as noted above, another translating or oscillating cutting components or members may be employed which can take advantage of the unique action of using the flexible leading edge 32 of the paddle 30, to urge the distal ends 34 of hair strands 12 projecting into the cutting cavity 13, into a cutting component 43 on one or both sides of the cutting cavity 13.

Also in FIG. 6, is shown an electric motor 60 employable for driving both the hair-paddle 30 and the translating bladed element 42. The motor 60 accomplishes this feat through the implementation of a novel combination geared-cam system that is comprised of a rotating motor shaft 62, an angular speed reduction gear 64, a perpendicular gearing assembly formed by two 45 degree angled gears 66, a cam-linkage assembly formed by an offset linkage attachment point 68, a linkage 70 and the freely rotating junction 76.

As the motor shaft 62 rotates, the angular speed reduction gear 64 rotates the hair-paddle 30 at a slower angular velocity than the motor shaft 62. This reduction in speed improves the safety of operation, and allows the motor 60 to operate within a more efficient portion of its power band. The reduction in angular velocity also allows the translating bladed element 42 to oscillate at a much higher frequency than if the hair-paddle 30 was not geared down and the motor 60 was forced to operate at a lower power level.

The translating bladed element 42 linearly oscillates as a result of the cam linkage 70 movement derived from the perpendicular gearing of the 45 degree gears 66. As the motor shaft 62 rotates, the angled gears 66 rotate a cam-disk 74 perpendicular to the motor shaft's 62 axis of rotation.

This cam disc 74 lies within a plane parallel to the planes containing the translating bladed element 42 and the cam linkage 70.

On this cam disc 74 there is an off-center attachment point 68 that joins the linkage 70 to the disc 74 while enabling free rotation of the linkage 70 about the off-center attachment point 68. As the disc 74 rotates, the off-center attachment point 68 orbits the axis of the disc's 74 rotation. While this orbiting movement occurs, the other distal end of the linkage 70 is fixed to the translating bladed element 42 with a freely rotating junction 76. Therefore, due to the linearly constrained characteristics of the translating bladed element 42, the linkage's distal end that is attached to the freely rotating junction 76 at the translating bladed element 42 also translates linearly, thus forcing the translating bladed element 42 to oscillate relative to its complimentary fixed counterpart, the fixed bladed elements 44. As this occurs, the torsion springs 46 translate and distort along the shaft 50 they are concentrically constrained to as they apply a compressive biasing unto the baseplate 58, the fixed bladed elements 44 and the translating bladed element 42 thereby holding them together.

Figure 7:
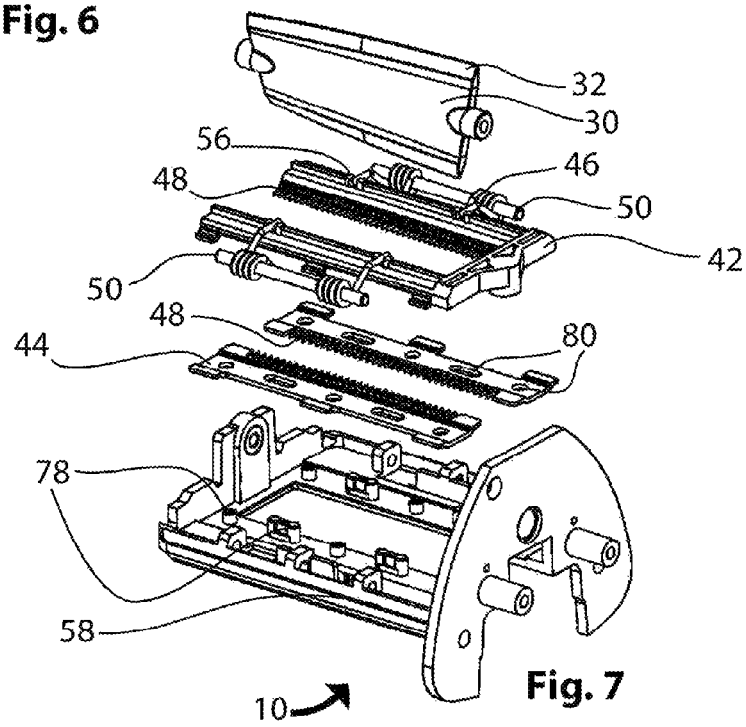
FIG. 7 depicts a perspective, exploded view of the cutting mechanism or cutting component of the device.

To better illustrate the disclosed assembly and operation of the aforementioned cutting components 43, an exploded perspective view is shown in FIG. 7. This figure more clearly illustrates the method of mating between the baseplate 58, the fixed bladed elements 44, and the translating bladed element 42. The fixed bladed elements 44 are constrained in all dimensions through the implementation of complimentary key-hole slot elements. There are a plurality of baseplate extrusions 78 that fit within an equal number of complimentary slots or recesses 80 that prevent the fixed bladed element from moving.

Figure 8:
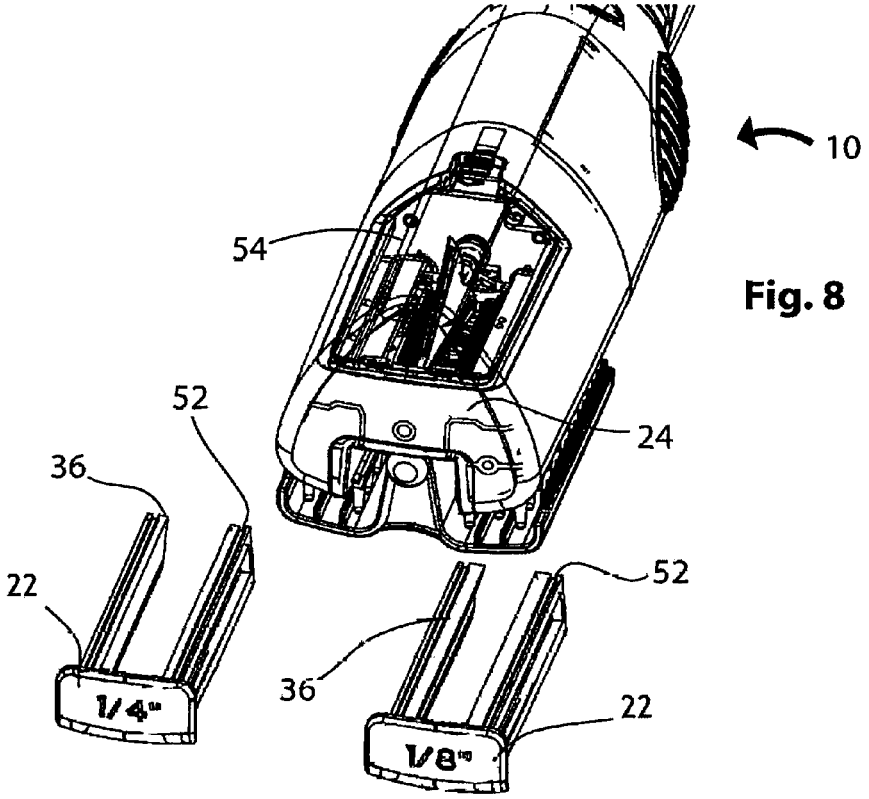
FIG. 8 depicts a perspective view of the device with a closed or as-used state of the positioning member descending into the formed recess in the face, and with the hair length adjusting elements which define sidewalls of the cavity removed.

FIG. 8 shows the device 10 in a perspective view of the device 10 showing the interchangeable cutting length component 22 removed from the device 10. This figure illustrates that there may be multiple sizes and forms of this interchangeable cutting length component 22 which can be provided such as in a kit, to allow the user to employ one corresponding to proportional lengths of hair shaft 12 trimming desired. The interchangeable cutting length components 22 are inserted within the cavity formed by the recess 15 a distance from the surface of the operatively positioned positioning member 14 and the apex 40 thereon, to change the distance between the apex 40, the surface of the positioning member 14 and the surface of the recess 15 surrounding them.

Figure 9:
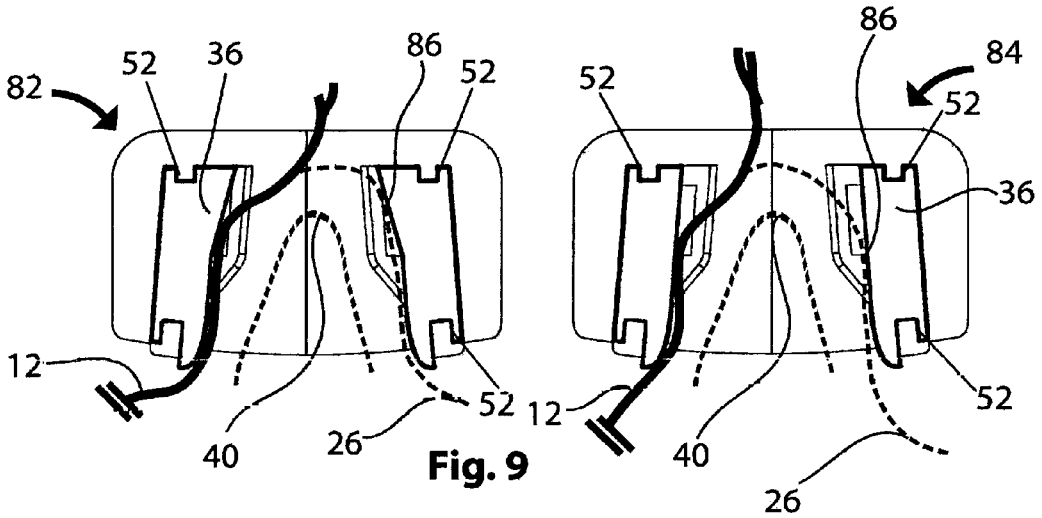
FIG. 9 depicts an end view of the device's hair length adjusting elements illustrating hair severance lengths based on wall thickness determining when a distal end will release contact with a sidewall and flip into the cutting chamber.

The effect of this distance change is more clearly illustrated in FIG. 9 where a hair shaft path 26 is shown with two different sized wall thicknesses 36. The thin-walled element 82 shown allows the distal end of the hair shaft 12 to release from the sandwiched engagement and rotate through the opening 21 across from the apex 40 and into the cutting cavity 13 sooner, thereby placing a greater amount of the distal end 34 of the hair shaft 12, protruding into the cutting cavity 13. Whereas, the thick-walled element 84 does the opposite. This difference in trimmed length occurs due to the bending of the hair shaft over the apex 40 which forces the hair shaft's distal end 34, once out of contact with the wall of the recess 15, to be thrust upwards into the cutting cavity 13 when the hair shaft's distal end 34 reaches the interchangeable cutting length component's interior surface 86. This trimming length is proportional to the distance between the apex 40 and the interchangeable cutting length component interior surface 86.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A hair trimming apparatus for trimming distal ends of hair drawn therethrough, comprising:

a body having a head portion and a handle portion extending from said head portion;

a recess depending into a face surface of said head portion, said recess having an opening therein communicating through said face surface with a cutting cavity within said head portion;

a positioning member having an open position with a gap between said face surface and said positioning member whereby hair strands are positionable between said positioning member and said face surface;

said positioning member having an as-used position with a surface of a central portion thereof depending within said recess, with said surface of said central portion spaced a distance from opposing sides of said recess;

said positioning member in said as-used position, forming a serpentine pathway configured for drawing said hair strands therethrough, said serpentine pathway configured for placing said hair strands in a sandwiched positioning between said opposing sides of said recess in said face surface and said surface of said central portion of said positioning member;

a paddle positioned in said cutting cavity in-between two opposing edges of said opening, said paddle having at least one pliable distal edge;

a first hair cutting component located adjacent at least one of said two opposing edges of said opening;

wherein distal ends of said hair strands drawn through said serpentine pathway and momentarily projecting into said cutting cavity through said opening, are pushed into said cutting component by a contact of said pliable distal edge of said paddle with said hair strands while rotating in a direction toward a bending contact of said pliable distal edge sliding against said cutting component, to thereby push said hair strands into said cutting component and to sever said distal ends from said hair strands.

2. The hair trimming apparatus for trimming distal ends of hair drawn therethrough of claim 1, additionally comprising:

a second hair cutting component located adjacent the other of said two opposing edges of said opening;

a selector, said selector positionable to choose a rotation direction of said paddle to push said distal ends toward one or the other of said hair cutting components located adjacent both said two opposing edges of said opening; and whereby a user can use said hair trimming apparatus on a first side of his/her head with said paddle rotating in a first direction toward said one hair cutting component, and can employ said selector to reverse rotation of said paddle when using said hair trimming apparatus on an opposite side of his/her head from said first side.

3. The hair trimming apparatus for trimming distal ends of hair drawn therethrough of claim 1 additionally comprising:

said at least one pliable distal edge having two pliable distal edges on opposing sides of said paddle; and each of said pliable distal edges configured for said bending contact while sliding against said cutting component.

4. The hair trimming apparatus for trimming the distal ends of hair drawn therethrough of claim 2 additionally comprising:

said at least one pliable distal edge having two pliable distal edges on opposing sides of said paddle; and each of said pliable distal edges configured for said bending contact while sliding against a respective one of said cutting components.

5. The hair trimming apparatus for trimming distal ends of hair drawn therethrough of claim 1 additionally comprising:

protrusions extending away from both of said face surface of said head portion and from said positioning member; and said protrusions dividing said serpentine pathway for said hair strands into multiple individual serpentine pathways.

6. The hair trimming apparatus for trimming the distal ends of hair drawn therethrough of claim 2 additionally comprising:

protrusions extending away from both of said face surface of said head portion and from said positioning member; and said protrusions dividing said serpentine pathway for said hair strands into multiple individual serpentine pathways.

7. The hair trimming apparatus for trimming distal ends of hair drawn therethrough of claim 3 additionally comprising:

protrusions extending away from both of said face surface of said head portion and from said positioning member; and said protrusions dividing said serpentine pathway for said hair strands into multiple individual serpentine pathways.

8. The hair trimming apparatus for trimming distal ends of hair drawn therethrough of claim 4 additionally comprising:

protrusions extending away from both of said face surface of said head portion and from said positioning member; and said protrusions dividing said serpentine pathway for said hair strands into multiple individual serpentine pathways.

9. The hair trimming apparatus for trimming distal ends of hair drawn therethrough of claim 1 additionally comprising:

interchangeable cutting length components engageable with said head portion on said opposing sides of said recess;

said interchangeable cutting length components having sizes which when engaged with said head portion, vary a width of a gap within said serpentine pathway defined by said distance between said opposing sides of said recess and said surface of said central portion of said positioning member; and whereby an insertion of said cutting length components which increases said gap will increase a length of said distal ends severed by said cutting component.

10. The hair trimming apparatus for trimming distal ends of hair drawn therethrough of claim 2 additionally comprising:

interchangeable cutting length components engageable with said head portion on said opposing sides of said recess;

said interchangeable cutting length components having sizes which when engaged with said head portion, vary a width of a gap within said serpentine pathway defined by said distance between said opposing sides of said recess and said surface of said central portion of said positioning member; and whereby an insertion of one of said interchangeable cutting length components which increases said gap will increase a length of said distal ends severed by said first and said second cutting components.

11. The hair trimming apparatus for trimming distal ends of hair drawn therethrough of claim 3 additionally comprising:

interchangeable cutting length components engageable with said head portion on said opposing sides of said recess;

said interchangeable cutting length components having sizes which when engaged with said head portion, vary a width of a gap within said serpentine pathway defined by said distance between said opposing sides of said recess and said surface of said central portion of said positioning member; and whereby an insertion of said cutting length components which increases said gap will increase a length of said distal ends severed by said cutting component.

12. The hair trimming apparatus for trimming distal ends of hair drawn therethrough of claim 4 additionally comprising:

interchangeable cutting length components engageable with said head portion on said opposing sides of said recess;

said interchangeable cutting length components having sizes which when engaged with said head portion, vary a width of a gap within said serpentine pathway defined by said distance between said opposing sides of said recess and said surface of said central portion of said positioning member; and whereby an insertion of one of said interchangeable cutting length components which increases said gap will increase a length of said distal ends severed by said first and said second cutting components.

13. The hair trimming apparatus for trimming distal ends of hair drawn therethrough of claim 7 additionally comprising:

interchangeable cutting length components engageable with said head portion on said opposing sides of said recess;

said interchangeable cutting length components having sizes which when engaged with said head portion, varying a width of a gap within said serpentine pathway defined by said distance between said opposing sides of said recess and said surface of said central portion of said positioning member; and whereby an insertion of said cutting length components which increases said gap will increase a length of said distal ends severed by said cutting component.

14. The hair trimming apparatus for trimming distal ends of hair drawn therethrough of claim 8 additionally comprising:

interchangeable cutting length components engageable with said head portion on said opposing sides of said recess;

said interchangeable cutting length components having sizes which when engaged with said head portion, varying a width of a gap within said serpentine pathway defined by said distance between said opposing sides of said recess and said surface of said central portion of said positioning member; and whereby an insertion of one of said interchangeable cutting length components which increases said gap will increase a length of said distal ends severed by said first and said second cutting components.

15. The hair trimming apparatus for trimming distal ends of hair drawn therethrough of claim 1 additionally comprising:

a reservoir for liquid located within a cavity in said positioning member; and apertures communicating between said reservoir and an exterior surface of said positioning member, whereby liquid in said reservoir is communicated to said hair strands as they are drawn through said serpentine pathway.

16. The hair trimming apparatus for trimming distal ends of hair drawn therethrough of claim 2 additionally comprising:

a reservoir for liquid located within a cavity in said positioning member; and apertures communicating between said reservoir and an exterior surface of said positioning member, whereby liquid in said reservoir is communicated to said hair strands as they are drawn through said serpentine pathway.

17. The hair trimming apparatus for trimming distal ends of hair drawn therethrough of claim 14 additionally comprising:

a reservoir for liquid located within a cavity in said positioning member; and apertures communicating between said reservoir and an exterior surface of said positioning member, whereby liquid in said reservoir is communicated to said hair strands as they are drawn through said serpentine pathway.

* * * * *